US008177865B2

(12) United States Patent
Shea et al.

(10) Patent No.: US 8,177,865 B2
(45) Date of Patent: May 15, 2012

(54) HIGH POWER DIESEL FUEL COMPOSITIONS COMPRISING METAL CARBOXYLATE AND METHOD FOR INCREASING MAXIMUM POWER OUTPUT OF DIESEL ENGINES USING METAL CARBOXYLATE

(75) Inventors: Timothy Michael Shea, The Woodlands, TX (US); Ralph Anthony Cherrillo, Houston, TX (US); Vinod Kumar Natarajan, Houston, TX (US)

(73) Assignee: Shell Oil Company, Houston, TX (US)

( * ) Notice: Subject to any disclaimer, the term of this patent is extended or adjusted under 35 U.S.C. 154(b) by 391 days.

(21) Appl. No.: 12/406,662

(22) Filed: Mar. 18, 2009

(65) Prior Publication Data

US 2010/0236510 A1 Sep. 23, 2010

(51) Int. Cl.
*C10L 1/12* (2006.01)
*C10L 1/188* (2006.01)

(52) U.S. Cl. ..... 44/354; 44/385

(58) Field of Classification Search ..... 44/354, 44/385, 403, 450

See application file for complete search history.

(56) References Cited

U.S. PATENT DOCUMENTS

| | | | | |
|---|---|---|---|---|
| 2,426,496 | A | 8/1947 | Farley | |
| 2,619,460 | A | 11/1952 | Neff | |
| 3,265,474 | A | 8/1966 | Siegel | |
| 3,271,310 | A | 9/1966 | LeSuer | |
| 3,615,290 | A | 10/1971 | Nixon | |
| 4,765,800 | A | 8/1988 | Van Es et al. | |
| 2003/0159337 | A1 | 8/2003 | Davenport et al. | |
| 2003/0221362 | A1 | 12/2003 | Collier et al. | 44/363 |
| 2004/0250466 | A1 * | 12/2004 | Fang et al. | 44/388 |
| 2006/0112614 | A1 | 6/2006 | Davenport et al. | 44/459 |
| 2006/0230672 | A1 * | 10/2006 | Collier et al. | 44/354 |
| 2007/0265479 | A1 | 11/2007 | Landschof | 585/14 |

FOREIGN PATENT DOCUMENTS

| | | | |
|---|---|---|---|
| EP | 1230327 | B1 | 6/2006 |
| EP | 1752512 | | 2/2007 |
| GB | 2447922 | | 10/2008 |
| WO | WO8700193 | | 1/1987 |
| WO | 97/40122 | A1 | 10/1997 |

* cited by examiner

*Primary Examiner* — Cephia D. Toomer
*Assistant Examiner* — Pamela H Weiss

(57) ABSTRACT

A high power diesel fuel composition and method for increasing immediate power output of a diesel engine using same, the high power diesel fuel composition comprising: about 50% v/v or more ultra low sulfur diesel fuel; and, from about 40 to about 60 ppmw of one or more metal carboxylate comprising one or more metal selected from the group consisting of alkali metals, manganese, iron, and combinations thereof; the diesel fuel composition having a cetane value of 48 or more.

39 Claims, 6 Drawing Sheets

| Fuel Blend | Units | A | B | C | D | E | F | G | H | I | J | K | L | M | N | O | P | Q | R | S | T | U | V | W | X | Y | Z | AA | BB | CC | DD |
|---|---|---|---|---|---|---|---|---|---|---|---|---|---|---|---|---|---|---|---|---|---|---|---|---|---|---|---|---|---|---|---|
| Base ULSD Fuel | %vol | 100 | | | 100 | 100 | 91 | 82 | 91 | 82 | 82 | 64 | 100 | 100 | 82 | 100 | 100 | 82 | 100 | 100 | 82 | | | 100 | 100 | 100 | 100 | 82 | 100 | 100 | 82 |
| Fischer-Tropsch derived fuel | %vol | | 100 | | | | 9 | 18 | | | 9 | 18 | | | 18 | | | 18 | | | 18 | 100 | 100 | | | | | 18 | | | 18 |
| MVI 65N™ Lube Base Oil | %vol | | | 100 | | | | | 9 | 18 | 9 | 18 | | | | | | | | | | | | | | | | | | | |
| 2-EHN Cetane Improver | ppm vol | | | | 600 | 1500 | | | | | | | | 1500 | | | 1500 | | | 1500 | | | | | | | 1500 | | | 1500 | |
| F7068™ | ppm mass | | | | | | | | | | | | 500 | 500 | 500 | 500 | 500 | 500 | 500 | 500 | 500 | | | | | 500 | 500 | 500 | | | |
| R-695 Lubricity Improver | ppm mass | | | | | | | | | | | | 500 | 500 | 500 | 500 | 500 | 500 | 500 | 500 | 500 | | | | | | | | 500 | 500 | 500 |
| Diethyl Amine Oleamide | ppm mass | | | | | | | | | | | | | | | 200 | 200 | 200 | | | | | | | | | | | | | |
| Glycerol Monoolelate | ppm mass | | | | | | | | | | | | | | | | | | 200 | 200 | 200 | | | | | | | | | | |
| Potassium Carboxylate | ppm mass | | | | | | | | | | | | | | | | | | | | | 50 | 250 | 50 | 250 | | | | | | |
| Parent fuel bled | | | | | | | | | | | | | A | E | G | L | E | G | A | E | G | B | B | A | A | A | E | G | A | E | G |

| Fuel Blend | Units | A | B | C | D | E | F | G | H | I | J | K | L | M | N | O | P | Q | R | S | T | U | V | W | X | Y | Z | AA | BB | CC | DD |
|---|---|---|---|---|---|---|---|---|---|---|---|---|---|---|---|---|---|---|---|---|---|---|---|---|---|---|---|---|---|---|---|
| Base ULSD Fuel | %vol | 100 | | | 100 | 100 | 91 | 82 | 91 | 82 | 82 | 64 | 100 | 100 | 82 | 100 | 100 | 82 | 100 | 100 | 82 | | | 100 | 100 | 100 | 100 | 82 | 100 | 100 | 82 |
| Fischer-Tropsch derived fuel | %vol | | 100 | | | | 9 | 18 | | | 9 | 18 | | | 18 | | | 18 | | | 18 | 100 | 100 | | | | | 18 | | | 18 |
| MVI 65N™ Lube Base Oil | %vol | | | 100 | | | | | 9 | 18 | 9 | 18 | | | | | | | | | | | | | | | | | | | |
| 2-EHN Cetane Improver | ppm vol | | | | 600 | 1500 | | | | | | | | 1500 | | | 1500 | | | 1500 | | | | | | | 1500 | | | 1500 | |
| F7068™ | ppm mass | | | | | | | | | | | | 500 | 500 | 500 | 500 | 500 | 500 | 500 | 500 | 500 | | | | | 500 | 500 | 500 | | | |
| R-695 Lubricity Improver | ppm mass | | | | | | | | | | | | 500 | 500 | 500 | 500 | 500 | 500 | 500 | 500 | 500 | | | | | | | | 500 | 500 | 500 |
| Diethyl Amine Oleamide | ppm mass | | | | | | | | | | | | | | | 200 | 200 | 200 | | | | | | | | | | | | | |
| Glycerol Monoolelate | ppm mass | | | | | | | | | | | | | | | | | | 200 | 200 | 200 | | | | | | | | | | |
| Potassium Carboxylate | ppm mass | | | | | | | | | | | | | | | | | | | | | 50 | 250 | 50 | 250 | | | | | | |
| Parent fuel bled | | | | | | | | | | | | | A | E | G | L | E | G | A | E | G | B | B | A | A | A | E | G | A | E | G |

*FIG. 1*

HIGH POWER DIESEL FUEL COMPOSITIONS COMPRISING METAL CARBOXYLATE AND METHOD FOR INCREASING MAXIMUM POWER OUTPUT OF DIESEL ENGINES USING METAL CARBOXYLATE

FIELD OF THE INVENTION

The present application provides high power diesel fuel compositions comprising metal carboxylate(s) and methods for increasing the maximum power output of diesel engines using metal carboxylate(s).

BACKGROUND

The objective of most conventional additives for diesel fuels is to improve the performance and/or environmental impact of the diesel engine operating over long distances. Because of this, common diesel fuel additives perform functions such as increasing fuel lubricity, decreasing corrosion or wear on engine parts, and/or decreasing emissions.

Some niche diesel applications do not involve driving over long distances. One example of a short distance diesel application is drag racing. Drag racing has been popular in Europe for some time, and is increasingly popular in the United States. In diesel drag races, the track typically is very short. Another example of a short distance diesel application is racing on closed circuits, which has also been gaining in popularity in Europe and the United States.

WO 97/40122 describes additives comprising a "synergistic combination" of two or more organometallic complexes of Group I metals together with a fuel-soluble carrier. The additives are said to provide an emissions benefit and to provide significant reduction in levels of soot and carbonaceous deposits that form on the combustion surfaces of engines in piston rings and ring bands, and in exhaust ports. The reduction in deposits is said to contribute to maintenance of engine performance in terms of emissions and longevity. The synergistic combination of two or more organometallic complexes also is said to permit regeneration of the particulate trap with greater reliability and frequency.

When a vehicle is used only intermittently over very short distances, as in diesel drag racing or racing on closed circuits, emission benefits and maintenance of engine performance over time are not of great concern.

What is needed during drag racing or racing on closed circuits is fuel additives that will increase immediate power output and speed of the diesel engine.

SUMMARY OF THE INVENTION

The present application provides a high power diesel fuel composition and method of increasing immediate power output of a diesel engine burning same, the diesel fuel composition comprising base diesel fuel and a concentration of one or more mono- or multi-carboxylic metal carboxylates.

In one embodiment, the application provides a high power diesel fuel composition comprising: about 50% v/v or more ultra low sulfur diesel fuel; and, from about 40 to about 60 ppmw of one or more metal carboxylate comprising one or more metal selected from the group consisting of alkali metals, manganese, iron, and combinations thereof; the diesel fuel composition having a cetane value of 48 or more.

In one embodiment, the application provides a high power diesel fuel composition comprising: about 50 vol. % or more base diesel fuel; and, from about 40 to about 60 ppmw of one or more mono- or multi-carboxylic potassium carboxylates; the diesel fuel composition having a cetane value of 48 or more.

In another embodiment, the application provides a high power diesel fuel composition comprising: about 50% v/v or more ultra low sulfur base diesel fuel (ULSD); from about 5% v/v to about 25% v/v basestock comprising substantially equal amounts of paraffinic basestock and naphthenic basestock; from about 40 ppmw to about 60 ppmw of one or more metal carboxylate selected from the group consisting of potassium succinate, potassium oleate, and combinations thereof; and, an amount of nitrate cetane improver effective to produce a cetane value of 48 or more.

In yet another embodiment, the application provides a method for increasing immediate power output of a diesel engine, the method comprising: providing the diesel engine with a diesel fuel composition having a cetane value of about 48 or more comprising about 50 vol. % or more base diesel fuel and a concentration of one or more mono- or multi-carboxylic metal carboxylates comprising one or more metal selected from the group consisting of alkali metals, manganese, iron, and combinations thereof; and, operating the diesel engine burning the diesel fuel composition under low speed and high power conditions, producing 2% or more increased immediate power output compared to the immediate power output produced by the same diesel engine burning the base diesel fuel, alone, under the same conditions.

BRIEF DESCRIPTION OF THE FIGURES

FIG. 1 is Table giving the composition of the fuels tested in Example 1.

DETAILED DESCRIPTION OF THE INVENTION

Figure 2:
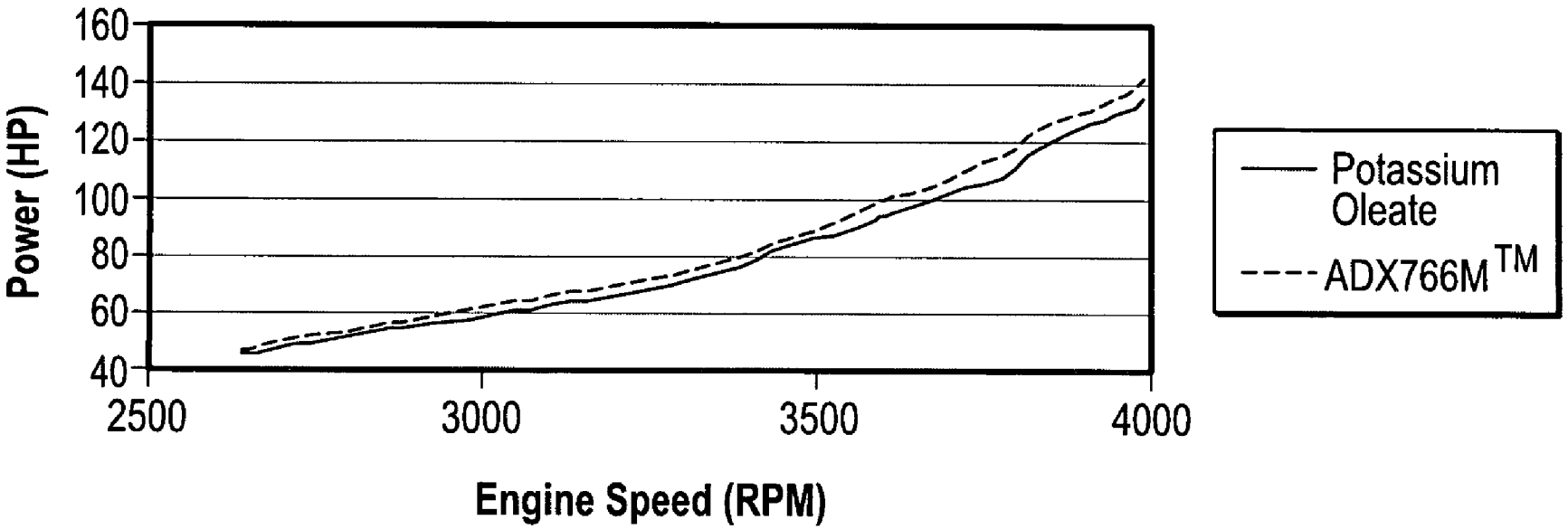
FIG. 2 is a chart of the horsepower produced by the potassium oleate and the ADX766M™ in Example 2.

The present application provides a diesel fuel composition that produces increased immediate power output and/or speed. In one embodiment, the diesel fuel composition produces increased immediate power output and increased immediate speed.

In one embodiment, the application provides a high power diesel fuel composition comprising: about 50 vol. % or more base diesel fuel and a concentration of one or more metal carboxylate. In one embodiment, the one or more metal carboxylate comprises one or more alkali metals. In one embodiment, the one or more metal carboxylate comprises potassium.

In one embodiment, the diesel fuel composition further comprises a quantity of basestock selected from the group consisting of paraffinic basestock, naphthenic basestock, and combinations thereof. In one embodiment, the basestock comprises a combination of paraffinic and naphthenic basestock. In one embodiment, the diesel fuel composition further comprises nitrogen-containing cetane improver. In one embodiment, the diesel fuel composition further comprises lubricity enhancer.

Combusting the diesel fuel composition in a diesel engine produces one or more of "increased immediate power output" and/or "increased immediate speed."

The phrases "increased immediate power output" and/or "increased immediate speed" mean, respectively, that one or more of increased horsepower (HP) and/or increased speed, respectively, is observed burning the diesel fuel composition in one or more of "Mode 1" (high load/high speed-representing peak power) and/or "Mode 2" (high load/intermediate speed-representing turning out of a curve). In one embodiment, burning the diesel fuel composition is effective to increase immediate power output in Mode 2 by 2% or more. In one embodiment, burning the diesel fuel composition is effective to increase immediate power output in Mode 2 by 6% or more.

As used herein, the phrase "high load" refers to an engine load of 100%. The phrase "low load" refers to an engine load of 50%. The phrase "high speed" refers to an engine speed of 2800 rpm; the phrase "intermediate speed" refers to an engine speed of 2200 rpm; and, the phrase "low speed" refers to an engine speed of 1600 rpm.

The diesel fuel composition is described hereafter in more detail.

The Base Diesel Fuel

The diesel fuel composition comprises a base diesel fuel. The base diesel fuel may be any diesel fuel suitable for operating a diesel engine.

Suitable base diesel fuels include any diesel fuel meeting the specifications set out in ASTM-D975-08A. The phrase "diesel fuel" typically refers to a distillate fuel which may be blended from a variety of refinery streams to meet desired specifications. Suitable diesel fuels typically have an initial distillation temperature of about 160° C. and a final distillation temperature of from about 290 and 360° C., depending on grade and use.

Suitable base diesel fuels include commercially available diesel fuels. Commercially available diesel fuels include, for example, No. 1 diesel fuels, No. 2 diesel fuels, ultra low sulfur diesel fuels (ULSD), and Fischer-Tropsch derived diesel fuels. Suitable diesel fuels may or may not include alkanol. Suitable diesel fuels may or may not comprise vegetable oil.

In one embodiment, the base diesel fuel is ultra low sulfur diesel (ULSD) fuel. In one embodiment, the base diesel fuel comprises one or more Fischer-Tropsch derived fuels. In one embodiment, the base diesel fuel comprises about 10% v/v or more Fischer-Tropsch derived fuel, based on the total weight of the base diesel fuel. In one embodiment, the base diesel fuel comprises from about 1% v/v to about 25% v/v Fischer-Trospch derived fuel. In one embodiment, the base diesel fuel is ULSD comprising about 10% v/v or more Fischer-Tropsch derived fuel.

By "Fischer-Tropsch derived fuel" is meant that the fuel is, derives from, or is produced from, a synthesis product of a Fischer-Tropsch condensation process directly and/or by further treatments. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures [e.g., from 125 to 300° C., typically from 175 to 250° C.) and/or pressures (e.g. from 500 to 10000 kPa (5 to 100 bar), typically from 1200 to 5000 kPa (12 to 50 bar)]. Hydrogen:carbon monoxide ratios other than 2:1 may be employed if desired. By virtue of the Fischer-Tropsch process, a Fischer-Tropsch derived gas oil has essentially no, or undetectable levels of, sulfur and nitrogen, and no or virtually no aromatic components. The aromatics content of a Fischer-Tropsch gas oil, based on the total weight of the Fischer-Tropsch gas oil, will typically be below 1% w/w, suitably below 0.5% w/w and more suitably below 0.1% w/w, as determined for instance by ASTM D5186.

Suitable Fischer-Tropsch derived fuels include, for example, reaction products of a Fischer-Tropsch methane condensation process such as the process known as Shell Middle Distillate Synthesis (SMDS). Suitable SMDS reaction products have boiling points within the typical diesel fuel range (from about 150 to about 370° C.), a density of from about 0.76 to about 0.79 g/cm$^3$ at 15° C., a cetane number of greater than 72.7 (typically from about 75 to about 82), a sulfur content of less than about 5 ppmw, a viscosity from about 2.9 to about 3.7 centistokes (mm$^2$/s) at 40° C., and an aromatics content of about 1% w/w or more, based on the total weight of the Fischer-Tropsch derived fuel.

The diesel fuel composition may comprise a relatively low density fuel, such as a fuel having a density of less than 0.840 g/cm$^3$, typically less than 0.835 g/cm$^3$, at 15° C.

In one embodiment, the diesel fuel composition comprises from about 50 vol. % to about 95 vol. % base diesel fuel, based on the total volume of the diesel fuel composition. In one embodiment, the diesel fuel composition comprises from about 50% v/v to about 90% v/v base diesel fuel. In one embodiment, the diesel fuel composition comprises from about 60% v/v to about 90% v/v base diesel fuel. In one embodiment, the diesel fuel composition comprises from about 70% v/v to about 90% v/v base diesel fuel. In one embodiment, the diesel fuel composition comprises from about 70% v/v to about 85% v/v base diesel fuel. In one embodiment, the diesel fuel composition comprises from about 70% v/v to about 75% v/v base diesel fuel.

Suitable Metal Carboxylates

The diesel fuel composition also comprises one or more metal carboxylate. In one embodiment, the metal carboxylate is mono- or multi-carboxylic.

In one embodiment, the metal carboxylate comprises one or more metals selected from the group consisting of alkali metals, manganese, and iron. In one embodiment, the metal carboxylate comprises one or more metals selected from the group consisting of alkali metals.

In one embodiment, the metal carboxylate comprises an alkali metal selected from the group consisting of lithium, sodium, potassium, rubidium, cesium, and francium. In one embodiment, the metal carboxylate comprises an alkali metal selected from the group consisting of lithium, sodium, and potassium. In one embodiment, the metal carboxylate comprises an alkali metal selected from the group consisting of sodium and potassium. In one embodiment, the metal carboxylate comprises an alkali metal selected from the group consisting of sodium and potassium. In one embodiment, the metal carboxylate comprises potassium.

Suitable specific metal carboxylates include, for example, metal succinates, metal oleates, metal acetates, metal acetylacetonates, metal hexanoates, metal hydrogen tartrates, metal tartrates, metal palmitates, metal phthalates, metal thioacetates, and combinations thereof. In one embodiment, the one or more metal carboxylates are selected from the group consisting of metal oleates, metal succinates, and combinations thereof.

In one embodiment, the metal is potassium, and the metal carboxylates are selected from the group consisting of potassium oleate, potassium succinate, potassium acetate, potassium acetylacetonate, potassium-2-ethyl hexanoate, potassium hydrogen tartrate, potassium tartrate, potassium palmitate, potassium phthalate, potassium thioacetate, and combinations thereof. In one embodiment, the metal carboxylates are selected from the group consisting of potassium oleate and potassium succinate.

In one embodiment, the diesel fuel composition comprises LUBRIZOL ADX766M™, a valve seat recession (VSR) additive comprising potassium carboxylate, which is commercially available from The Lubrizol Corporation.

The one or more metal carboxylate may be added directly to the diesel fuel composition or in the form of an additive composition comprising the one or more metal carboxylate dispersed in a suitable organic carrier. Suitable organic carriers are fuel-soluble carriers that are miscible in all proportions with the respective fuel. Suitable organic carriers for the metal carboxylate include, for example: kerosene, petroleum naphtha, n-heptane, and hexadecane. Other suitable carrier liquids miscible with diesel fuel will be apparent to persons of ordinary skill in the art.

Where the metal carboxylate is provided in the form of an additive composition, the concentration of metal carboxylate in the additive composition is as high as possible based on the solubility of the metal carboxylate in the carrier and on the viscosity of the resulting additive composition. In one embodiment, the additive composition comprises from about 10% w/w to about 90% w/w metal carboxylate. In one embodiment, the additive composition comprises from about 40% w/w to about 60% w/w metal carboxylate.

LUBRIZOL ADX766M™ valve seat recession additive comprises from about 10 ppm to about 50 ppm potassium carboxylate) in a kerosene and petroleum naphtha carrier.

In one embodiment, the diesel fuel composition comprises from about 1 ppmw to about 150 ppmw active metal concentration. In one embodiment, the diesel fuel composition comprises from about 30 to about 130 ppmw active metal concentration. In one embodiment, the diesel fuel composition comprises from about 40 to about 120 ppmw active metal concentration. In one embodiment, the diesel fuel composition comprises from about 40 to about 60 ppmw active metal concentration. In one embodiment, the diesel fuel composition comprises from about 45 to about 55 ppmw active metal concentration. In one embodiment, the diesel fuel composition comprises about 50 ppmw active metal concentration.

Paraffinic and/or Naphthenic Basestock

The diesel fuel composition may or may not comprise one or more paraffinic and/or naphthenic basestock.

In one embodiment, the diesel fuel composition comprises one or more paraffinic basestock. In one embodiment, the diesel fuel composition comprises one or more naphthenic basestock. In one embodiment, the diesel fuel composition comprises a combination of one or more paraffinic basestock and one or more naphthenic basestock.

Suitable paraffinic basestocks may be derived from a number of sources. Suitable paraffinic basestocks comprise about 75% v/v or more paraffins having from about 10 to about 35 carbon atoms. In one embodiment, the paraffinic basestock comprises about 10% v/v or more paraffins. In one embodiment, the paraffinic basestock comprises about 90% v/v or more paraffins. The paraffinic basestock may comprise about 80% v/v or less isoparaffins. In one embodiment, the paraffinic basestock comprises 70% v/v or less isoparaffins.

A wide variety of paraffinic basestocks are commercially available. In one embodiment, the paraffinic basestock is STAR 4™, which is commercially available from Shell Lubricants Company. In one embodiment, the basestock comprises one or more paraffinic Fischer-Tropsch derived fuels, as described above.

Suitable naphthenic basestocks also may be derived from a variety of sources. Suitable naphthenic basestocks comprise cycloparaffins having from about 5 to about 40 carbon atoms. Suitable commercially available naphthenic basestocks include, for example, HYNAP® 60 (commercially available from San Joaquin Refining Co., Inc.) and HYGOLD 60™ (commercially available from Ergon Specialty Oils).

In one embodiment, the diesel fuel composition comprises a combination of STAR 4™ and HYGOLD 60™. In one embodiment, the diesel fuel composition comprises a combination of STAR 4™ and HYNAP® 60.

In one embodiment, the diesel fuel composition comprises from about 5 vol. % to about 25 vol. % basestock, based on the total volume of the diesel fuel composition. In one embodiment, the diesel fuel composition comprises from about 10% v/v to about 25% v/v basestock. In one embodiment, the diesel fuel composition comprises from about 15% v/v to about 25% v/v basestock. In one embodiment, the diesel fuel composition comprises from about 20% v/v to about 25% v/v basestock. In one embodiment, the diesel fuel composition comprises about 20% v/v basestock.

In one embodiment, the diesel fuel composition comprises basestock comprising a combination of paraffinic and naphthenic basestock. In one embodiment, the basestock comprises a combination of substantially equal portions of paraffinic and naphthenic basestock. In one embodiment, the amount and composition of the basestock produces a diesel fuel composition comprising from about 2% v/v to about 13% v/v of paraffinic basestock and from about 2% v/v to about 13% v/v of naphthenic basestock, based on the total volume of the diesel fuel composition. In one embodiment, the amount and composition of the basestock produces diesel fuel composition comprising from about 5% v/v to about 10% v/v of paraffinic basestock and from about 5% v/v to about 10% v/v of naphthenic basestock. In one embodiment, the amount and composition of the basestock produces diesel fuel composition comprising from about 8% v/v to about 10% v/v of paraffinic basestock and from about 8% v/v to about 10% v/v of naphthenic basestock.

Cetane Improver

In one embodiment, the diesel fuel composition comprises one or more cetane improvers. Suitable cetane improvers include, for example, oxygenates, Fischer-Tropsch derived fuels, and nitrogen containing compounds.

In one embodiment, the cetane improver comprises oxygenate(s). In one embodiment, the diesel fuel composition comprises from about 5 to about 25 v/v % oxygenate(s) as a cetane improver. In one embodiment, the cetane improver comprises diethyl ether.

In one embodiment, the diesel fuel composition comprises Fischer-Tropsch derived fuel. In one embodiment, the diesel fuel composition comprises from about 5 to about 25 v/v % Fischer-Tropsch derived fuel as a cetane improver.

In one embodiment, the cetane improver is one or more nitrogen-containing compound. In one embodiment the nitrogen-containing compound is selected from the group consisting of nitrates, nitrites, and azo compounds. In one embodiment, the cetane improver is one or more organic nitrates. Suitable organic nitrates include, for example, alkyl nitrates. Suitable alkyl nitrates include, for example, amyl nitrates, hexyl nitrates, cyclohexyl nitrates, and octyl nitrates.

In one embodiment, the cetane improver is 2-ethylhexyl nitrate (2-EHN). A suitable 2-ethyhexyl nitrate is commercially available from the Associated Octel Company Limited as is "C1-0801™."

In one embodiment, the diesel fuel composition comprises from about 0.25% v/v about 20% v/v nitrogen containing cetane improver. In one embodiment, the diesel fuel composition comprises about 0.5% v/v or more, or 0.75% v/v or more, or 1% v/v or more cetane improver. In one embodiment, the diesel fuel composition comprises from about 5% v/v about 15% v/v nitrogen containing cetane improver.

In one embodiment, the diesel fuel composition comprises an organic nitrate at an (active matter) concentration of about 10 ppmw or more; in one embodiment, about 20 ppmw or more. In one embodiment, the active matter concentration of the organic nitrate is about 600 ppmw or less, or about 500 ppmw or less. In one embodiment, the active matter concentration of the organic nitrate is from about 300 ppmw to about 500 ppmw.

In one embodiment, the cetane improver is effective to produce a cetane number of 48 or more. In one embodiment, the cetane improver is effective to produce a cetane number of 50 or more. In one embodiment, the cetane improver is effective to produce a cetane number of 60 or more.

Lubricity Enhancer

In one embodiment, the diesel fuel composition comprises one or more lubricity enhancers. In one embodiment comprising lubricity enhancer, the diesel fuel composition has a "low" sulfur content. As used herein, the phrase "low" sulfur content means a sulfur content of about 500 ppmw or less.

Suitable commercially available lubricity enhancers include, for example, amide-based additives, ester based additives, dimerized fatty acids, aminoalkylmorpholines, dithiophosphoric diester-dialcohols, and alkyl aromatic compounds having at least one carboxyl group attached to their aromatic nuclei.

In one embodiment, the lubricity enhancer is an ester based lubricity enhancer. Suitable ester based lubricity enhancers include carboxylic acid ester/alcohols having from 2 to 50 carbon atoms wherein the alcohol has 1 or more carbon atoms. Suitable carboxylic acid ester/alcohols include, for example, glycerol monooleate and di-isodecyl adipate ester. Suitable commercially available ester based lubricity enhancers include, for example, INFINEUM® R620™, R621™, R655™, R690™, R694™, and R695™, and others, commercially available from INFINEUM®.

Suitable dimerized fatty acids comprise fatty acids having from about 5 to about 40 carbon atoms. Examples include dimerized linoleic acid, dimerized lauric acid, dimerized palmitic acid, dimerized stearic acid, and the like.

Other suitable commercially available lubricity enhancers include, for example: LZ539™ and ADX4101™, acidic lubricity additives commercially available from Lubrizol; HITEC® 4142™, an acidic lubricity additive commercially available from Afton Chemical Corporation, ARMOSTAT® 700™ and ETHOMEEM™ T12™, amine based lubricity additives commercially available from Akzo Nobel, and HITEC® 6457™, an amine based lubricity additive commercially available from Afton Chemical Corporation.

In one embodiment, the diesel fuel composition comprises from about 50 ppmw to about 1000 ppmw lubricity enhancer. In one embodiment, the diesel fuel composition comprises from about 100 to about 1000 ppmw lubricity enhancer. In one embodiment, the diesel fuel composition comprises from about 100 to about 500 ppmw lubricity enhancer. In one embodiment, the diesel fuel composition comprises about 250 to about 350 ppmw lubricity enhancer.

Other Additives

The diesel fuel composition also may comprise other additives.

In one embodiment, the diesel fuel composition comprises one or more soot mitigation additives. Suitable soot mitigation additives include, for example, amine additives, alkanol additives, and combinations thereof. In one embodiment, the diesel fuel composition comprises one or more soot mitigation additive comprising amine. Suitable amines for use as soot mitigation additives include, for example, alkyl amines having from about 5% v/v to about 15% v/v carbon atoms. Examples of suitable alkyl amines include cyclohexane, aniline, n-butyl aniline, and/or naphthylamine. In one embodiment, the diesel fuel composition comprises soot mitigation additive comprising cyclohexylamine. In one embodiment, the diesel fuel composition comprises from about 1% v/v to about 10% v/v cyclohexylamine, based on the total volume of the diesel fuel composition. In one embodiment, the diesel fuel composition comprises from about 4% v/v to about 6% v/v cyclohexylamine.

In one embodiment, the diesel fuel composition comprises one or more soot mitigation additives comprising alkanol. Suitable alkanols for use as soot mitigation additives include, for example, alkanols having from about 2 to about 18 carbon atoms. Examples of suitable alkanols include ethanol, n-butanol, and/or dodecanol. In one embodiment, the diesel fuel composition comprises dodecanol.

In one embodiment, the diesel fuel composition comprises from about 1% v/v to about 10% v/v dodecanol, based on the total volume of the diesel fuel composition. In one embodiment, the diesel fuel composition comprises from about 4% v/v to about 6% v/v dodecanol on the same basis.

The diesel fuel composition also optionally may comprise one or more other diesel fuel additives. Suitable other diesel fuel additives include, for example, diesel fuel additives as listed in ASTM D975 (2008), incorporated herein by reference, or as specified by a regulatory body, e.g., U.S. California Air Resources Board (CARB) or the U.S. Environmental Protection Agency (EPA).

Examples of suitable other diesel fuel additives include: detergents; dehazers; antifoaming agents; and, ant-rust agents.

Examples of suitable dehazers include alkoxylated phenol formaldehyde polymers. Suitable commercially available alkoxylated phenol formaldehyde polymers include NALCO™ EC5462A™ (formerly 7D07™), commercially available from Nalco, and TOLAD™ 2683™, commercially available from Baker Petrolite.

Examples of suitable anti-foaming agents include polyether-modified polysiloxanes. Suitable polyether-modified polysiloxanes include TEGOPREN™ 5851™ and Q 25907™, commercially available form Dow Corning; and, SAG™ TP-325™ (ex OSi), or RHODORSIL™, commercially available form Rhone Poulenc.

Examples of suitable anti-rust agents include "RC 4801™", a propane-1, 2-diol semi-ester of tetrapropenyl succinic acid, commercially available from Rhein Chemie, Mannheim, Germany. Also suitable are polyhydric alcohol esters of succinic acid derivatives, the succinic acid derivative having on at least one of its alpha-carbon atoms an unsubstituted or substituted aliphatic hydrocarbon group containing from 20 to 500 carbon atoms, for example, the pentaerythritol diester of polyisobutylene-substituted succinic acid.

Examples of suitable anti-oxidants include phenolics and pheneylenediamines. Suitable phenolics include, for example, 2,6-di-tert-butylphenol. Suitable phenylenediamines include, for example, N,N'-di-sec-butyl-p-phenylenediamine.

Unless otherwise stated, the (active matter) concentration of each "other" additive in the diesel fuel composition, is about 1% w/w or less; in one embodiment, from about 5 to about 1000 ppmw; in one embodiment, from about 75 to about 300 ppmw; and in one embodiment, from about 95 to about 150 ppmw.

The application will be better understood from the following examples, which are illustrative only and should not be construed as limiting the claims:

EXAMPLE 1

Candidate blends comprising primarily ULSD diesel fuel or F-T derived diesel fuel with and without a sufficient amount of ADX766M™ (potassium carboxylate) to produce an active metal concentration of 2 ppmw and 10 ppmw were prepared and screened to determine engine performance over a representative range of engine operating conditions. The composition of the candidate blends is shown in FIG. 1. In FIG. 1, MVI 65N™ is a lube base oil, commercially available from Ergon Specialty Oils. F7068™ is a lubricity/detergent additive, commercially available from INFINEUM®.

A series of tests was performed operating a 2.0 L turbocharged Kubota engine using the candidate blends to determine which formulations posed benefits in power and/or torque. Also tested were regulated emissions. The tests were run in six modes: Mode 1 (high load/high speed); Mode 2 (high load/intermediate speed); and, Mode 3 (high load/low speed); Mode 4 (low load, high speed); Mode 5 (low load, intermediate speed); and, Mode 6 (low load, low speed). The engine loads were 100% ("high load") and 50% ("low load"). The speeds tested were (1) 2800 rpm ("high speed"); (2) 2200 rpm ("intermediate speed"), and (3) 1600 rpm ("low speed").

It was determined that adding ADX766M™ to either conventional diesel fuel or to Fischer-Tropsch derived fuel at a sufficient concentration to produce 50 ppmw active matter potassium produced power improvements of about 2.25% (1.3 HP) for base diesel fuel and almost 6% (3.1 HP) for the Fischer-Tropsch derived Fuel in Mode 1 and Mode 2. However, the same fuels comprising 250 ppmw of the ADX766M™ did not exhibit further increased power output. In fact, the power output decreased.

EXAMPLE 2

Blends were prepared comprising ULSD and about 5_ppm active metal concentration of either (a) ADX766M™ or (b) potassium oleate. The blends were tested for power output and torque using a 6B SSpuller engine. The blends were tested for power output at speeds of from 2500 to 4000 rpm. The blends were tested for torque at speeds of from 0 to 35 rpm. The results are given in FIGS. 2-3.

Figure 3:
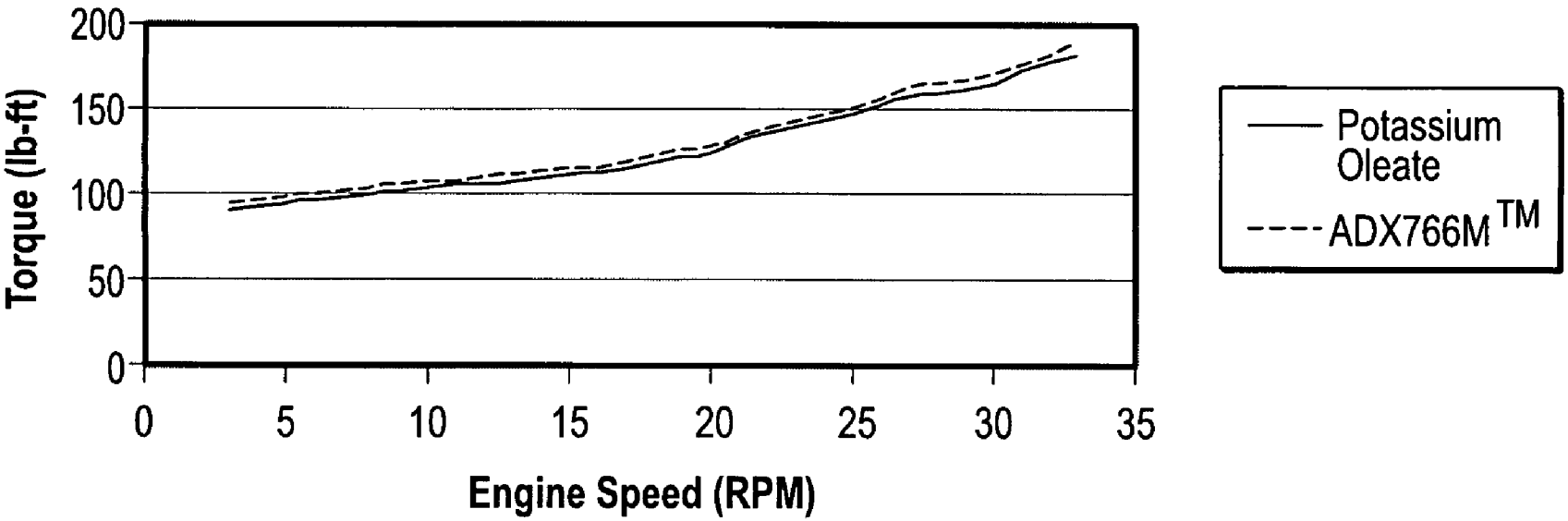
FIG. 3 is a chart of the torque produced by the potassium oleate and the ADX766M™ in Example 2.

As seen from FIGS. 2 and 3, the increase in torque and power achieved using the potassium oleate mirrored the increases in torque and power achieved using ADX766M™, indicating that potassium was responsible for the increases in power and torque.

EXAMPLE 3

A series of tests was performed using various blendstocks and additives to determine resulting power and emissions. The candidate blends had the following compositions:

| Quantitative | 0 | 1 | 2 | 3 | 4 | 5 | 6 |
|---|---|---|---|---|---|---|---|
| Base Diesel Fuel: 2007 ULSD non-add | 10 gal | 4.1 gal | 4.1 gal | 4.1 gal | 3.85 gal | 3.85 gal | 4.1 gal |
| Paraffinic Lube: STAR 4 ™ | | 0.9 gal | | 0.45 gal | | 0.45 gal | 0.45 gal |
| Naphthenic Lube: HYGOLD 60 ™ | | | 0.9 gal | 0.45 gal | 0.9 gal | 0.45 gal | 0.45 gal |
| ADX766M ™ (Lubrizol)* | | 0.794 g | 0.800 g | 0.797 g | 0.801 g | 0.798 g | |
| Cyclohexylamine | | | | | 0.25 gal | 0.25 gal | |

*The ADX766M ™ was potassium carboxylate in a kerosene/petroleum naphtha mixture. The total amount of potassium carboxylate was 50 ppm.

The following were the densities of various components:

| | |
|---|---|
| ULSD: | 0.835 kg/L |
| STAR 4 ™: | 0.856 kg/L |
| HYGOLD 60 ™: | 0.893 kg/L |
| cyclohexylamine: | 0.867 kg/L |

Based on the foregoing densities, the candidate blends had the following volume % composition:

| Composition by Percentage | 0 | 1 | 2 | 3 | 4 | 5 | 6 |
|---|---|---|---|---|---|---|---|
| Base Diesel Fuel: 2007 ULSD non-add | 100% | 82% | 82% | 82% | 77% | 77% | 82% |
| Paraffinic Lube: STAR 4 ™ | | 18% | | 9% | | 9% | 9% |
| Naphthenic Lube: HYGOLD 60 ™ | | | 18% | 9% | 18% | 9% | 9% |
| ADX766M ™* (Lubrizol) | | 50 ppmw | 50 ppmw | 50 ppmw | 50 ppmw | 50 ppmw | |
| cyclohexylamine | | | | | 5% | 5% | |

The blends were evaluated in Modes 1, 2, and 3 (rather than the 6 Modes tested in Example 1). The following data was collected, together with emissions data. Although emissions data was collected, emissions generally are not given as much consideration as power, speed, and torque in drag racing applications.

The data is summarized in the following Table:

| Relative % change compared to control | | | |
|---|---|---|---|
| Candidate Blend | HP-Mode 1% | HP-Mode 2% | HP-Mode 3% |
| 0 | 100.00 | 100.00 | 100.00 |
| 0 | 99.80 | 101.45 | 99.96 |
| 1 | 100.22 | 101.79 | 100.20 |
| 2 | 100.79 | 101.80 | 100.20 |
| 3 | 101.28 | 102.64 | 101.92 |
| 4 | 101.00 | 100.73 | 101.79 |
| 5 | 99.41 | 101.13 | 102.37 |
| 6 | 100.57 | 102.61 | 102.42 |
| 7 | 97.55 | 99.08 | 102.08 |
| 8 | 98.40 | 100.47 | 100.01 |

Figure 4:
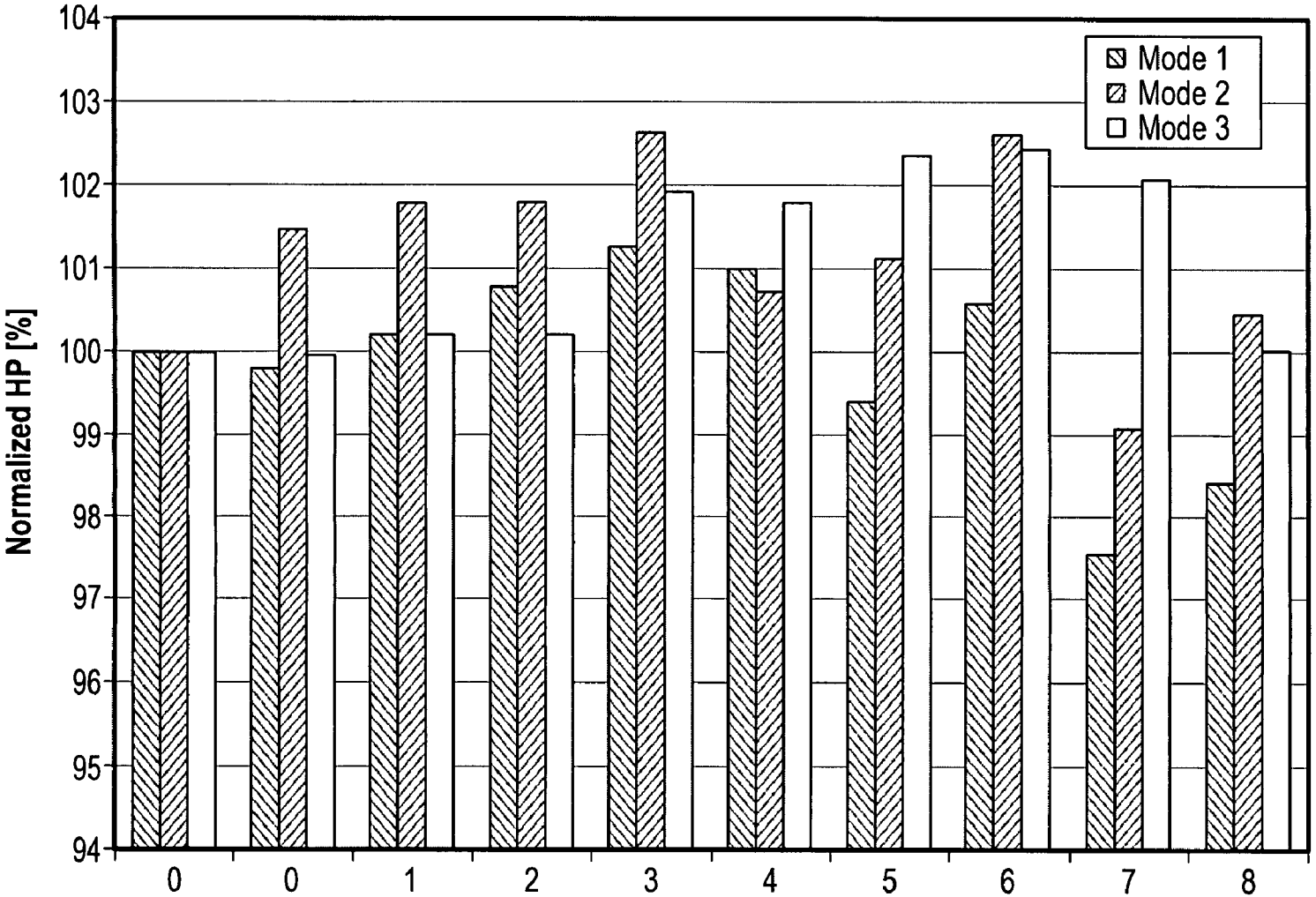
FIG. 4 is a chart of the normalized horsepower produced by the candidate blends tested in Example 3.

The data also is illustrated in FIG. 4.

As seen in FIG. 4, blends 3 and 6, comprising approximately 50 ppmw potassium carboxylate, produced higher maximum power output in Mode 1 and Mode 3 relative to the base diesel fuel (Blend 0). It was also determined that blending a combination of paraffinic and naphthenic lubricating base oils into the diesel fuel composition in blends 3 and 6 yielded a synergistic benefit.

Figure 5:
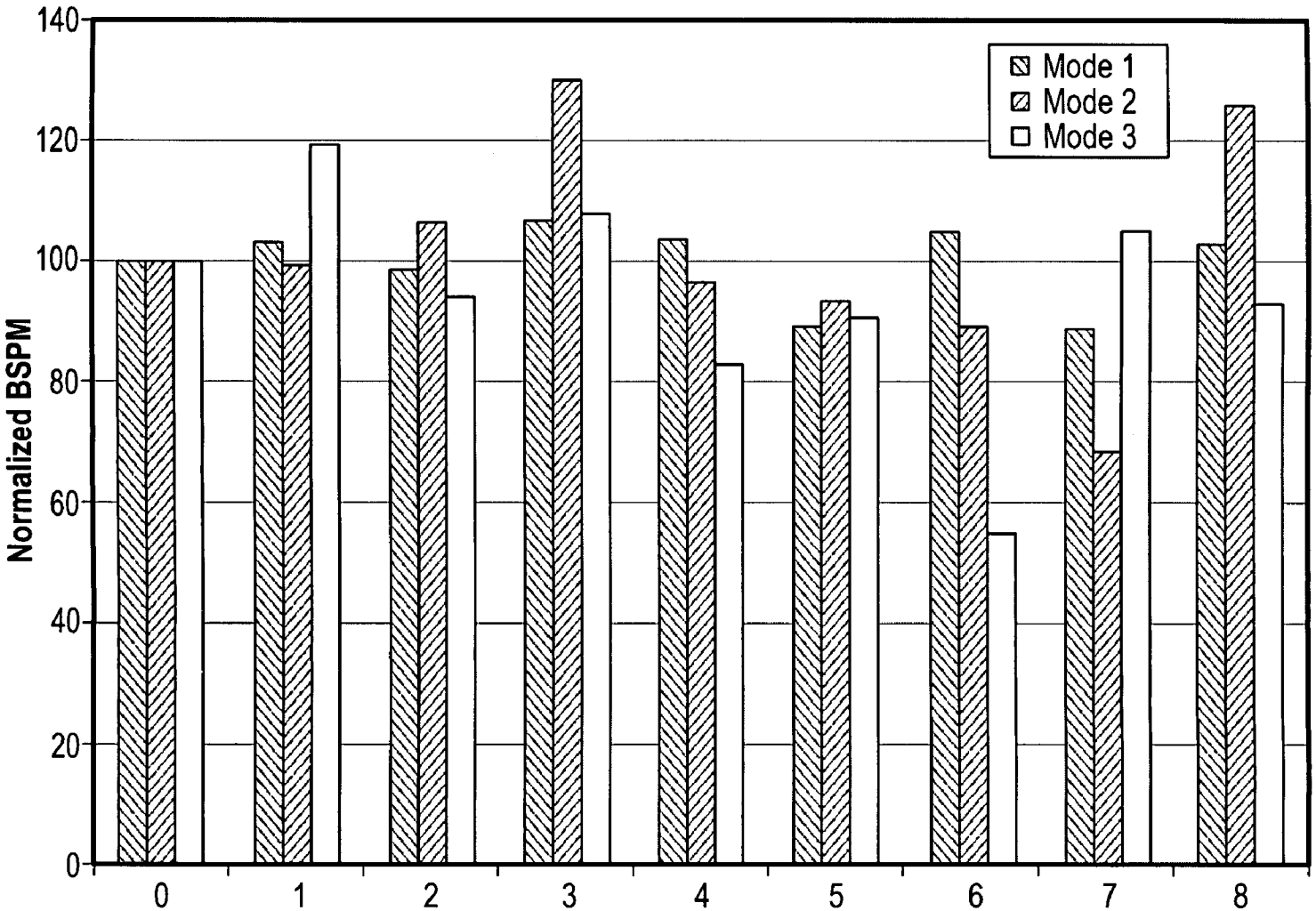
FIG. 5 is a chart of the normalized particulate emissions (BSPM) produced by the candidate blends in Example 3.

The following were the results for particulate emissions (see also FIG. 5):

| Candidate | PM-mode 1 g/(hp-hr) | PM-mode 2 g/(hp-hr) | PM-mode 3 g/(hp-hr) | PM-mode 1 % | PM-mode 2 % | PM-mode 3 % |
|---|---|---|---|---|---|---|
| 0 | 0.0650 | 0.3384 | 0.0478 | 100.00 | 100.00 | 100.00 |
| 0 | — | — | — | — | — | — |
| 1 | 0.0670 | 0.3363 | 0.0572 | 103.14 | 99.36 | 119.55 |
| 2 | 0.0643 | 0.3596 | 0.0450 | 98.95 | 106.24 | 94.11 |
| 3 | 0.0694 | 0.4409 | 0.0516 | 106.81 | 130.27 | 107.92 |
| 4 | 0.0675 | 0.3268 | 0.0397 | 103.85 | 96.58 | 82.91 |
| 5 | 0.0580 | 0.3162 | 0.0434 | 89.25 | 93.44 | 90.79 |
| 6 | 0.0681 | 0.3018 | 0.0263 | 104.84 | 89.18 | 55.03 |
| 7 | 0.0578 | 0.2310 | 0.0503 | 88.87 | 68.26 | 105.18 |
| 8 | 0.0668 | 0.4254 | 0.0444 | 102.80 | 125.70 | 92.92 |

The following were the results for $NO_x$ emissions (see also FIG. 6):

| Candidate | $NO_x$-mode 1 g/(hp-hr) | $NO_x$-mode 2 g/(hp-hr) | $NO_x$-mode 3 g/(hp-hr) | $NO_x$-mode 1 % | $NO_x$-mode 2 % | $NO_x$-mode 3 % |
|---|---|---|---|---|---|---|
| 0 | 2.859 | 2.111 | 4.727 | 100.00 | 100.00 | 100.00 |
| 0 | 2.905 | 2.032 | 4.797 | 101.60 | 96.26 | 101.48 |
| 1 | 2.848 | 1.966 | 4.621 | 99.61 | 93.11 | 97.78 |
| 2 | 2.820 | 1.970 | 4.671 | 98.63 | 93.34 | 98.83 |
| 3 | 2.753 | 1.928 | 4.626 | 96.28 | 91.33 | 97.87 |
| 4 | 3.118 | 2.048 | 5.317 | 109.05 | 97.00 | 112.49 |
| 5 | 3.147 | 2.061 | 5.180 | 110.06 | 97.65 | 109.59 |
| 6 | 2.925 | 2.020 | 4.953 | 102.30 | 95.68 | 104.79 |
| 7 | 2.961 | 2.080 | 4.790 | 103.55 | 98.52 | 101.34 |
| 8 | 2.904 | 2.032 | 4.842 | 101.56 | 96.27 | 102.45 |

Figure 6:
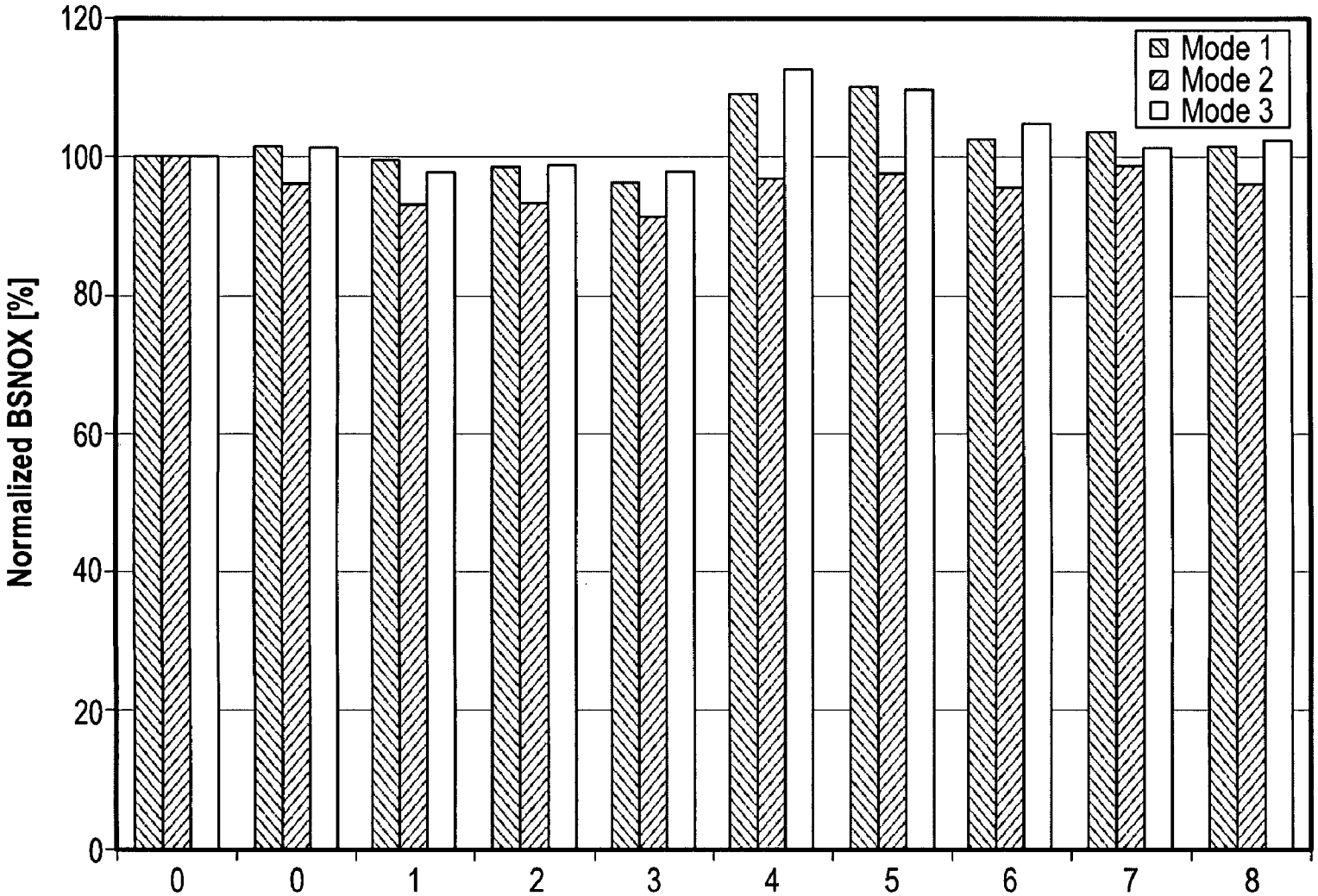
FIG. 6 is a chart of the normalized $NO_x$ ($BSNO_x$) produced by the candidate blends in Example 3.

As seen from FIG. 6, although Candidate 3 produced higher horsepower, $NO_x$ emissions were lower than for the base diesel (Candidate 0). This was surprising because lower $NO_x$ emissions typically indicate cooler combustion, which would lead one to expect less power output rather than higher immediate power output.

EXAMPLE 4

A series of tests was performed to compare a "road" ULSD to candidate blends, both comprising ADX766M™, alone, or with cetane booster. The candidate blends had the following volume % (or ppm) compositions, based on the total volume of the candidate blend:

| | 0 | 1 | 2 |
|---|---|---|---|
| ULSD | 82% | 72% | 72% |
| STAR 4 ™ | 9% | 9% | 9% |
| HYNAP ® 60 ™ | 9% | 9% | 9% |
| ADX766M ™ (ppm) | 50 | 50 | 50 |
| F-T derived fuel | | 10% | |
| 2-EHN | | | 10% |

Candidate 0, the ULSD alone, produced 960 HP and 1889 ft-lb torque. Candidate 2, with 10% v/v F-T derived fuel, produced 956 horsepower and 1834 ft-lb torque. Candidate 3, with 10% EHN (cetane booster), produced 972 horsepower and 1900 ft-lb torque. In other words, Candidate 3 produced both increased immediate power output and increased immediate torque compared to the ULSD alone.

Persons of ordinary skill in the art will recognize that many modifications may be made to the foregoing description. The embodiments described herein are meant to be illustrative only and should not be taken as limiting the invention, which will be defined in the claims.

We claim:

1. A high power diesel fuel composition comprising:

about 50% v/v or more ultra low sulfur diesel fuel;

from about 40 to about 60 ppmw of one or more metal carboxylate comprising one or more metal selected from the group consisting of alkali metals, manganese, iron, and combinations thereof; and a quantity of basestock having density of at least 0.856 kg/L comprising a combination of from about 2% v/v to about 13% v/v of paraffinic basestock and from about 2% v/v to about 13% v/v of naphthenic basestock;

the diesel fuel composition having a cetane number of 48 or more.

2. The high power diesel fuel composition of claim 1 wherein the metal is selected from the group consisting of alkali metals.

3. The high power diesel fuel composition of claim 1 further comprising an amount of cetane improver effective to produce the cetane number of 48 or more.

4. The high power diesel fuel composition of claim 2 further comprising an amount of cetane improver effective to produce the cetane number of 48 or more.

5. The high power diesel fuel composition of claim 1 wherein the quantity of basestock is from about 5% v/v to about 25% v/v of the high power diesel fuel composition.

6. The high power diesel fuel composition of claim 4 wherein the quantity of basestock is from about 5% v/v to about 25% v/v of the high power diesel fuel composition.

7. The high power diesel fuel composition of claim 1 wherein the basestock comprises substantially equal amounts of paraffinic basestock and naphthenic basestock.

8. The high power diesel fuel composition of claim 5 wherein the basestock comprises substantially equal amounts of paraffinic basestock and naphthenic basestock.

9. The high power diesel fuel composition of claim 6 wherein the basestock comprises substantially equal amounts of paraffinic basestock and naphthenic basestock.

10. The high power diesel fuel composition of claim 1 further comprising from about 50 ppmw to about 1000 ppmw lubricity enhancer.

11. The high power diesel fuel composition of claim 9 further comprising from about 50 ppmw to about 1000 ppmw lubricity enhancer.

12. A high power diesel fuel composition comprising:

about 50 vol. % or more base diesel fuel;

from about 40 to about 60 ppmw of one or more mono- or multi-carboxylic potassium carboxylates; and a basestock having density of at least 0.856 kg/L comprising a combination of from about 2% v/v to about 13% v/v of paraffinic basestock and from about 2% v/v to about 13% v/v of naphthenic basestock;

the diesel fuel composition having a cetane number of 48 or more.

13. The high power diesel fuel composition of claim 12 comprising substantially equal amounts of paraffinic basestock and naphthenic basestock.

14. The high power diesel fuel composition of claim 12 further comprising an amount of cetane improver effective to produce the cetane number of 48 or more.

15. The high power diesel fuel composition of claim 13 further comprising an amount of cetane improver effective to produce the cetane number of 48 or more.

16. The high power diesel fuel composition of claim 14 wherein the quantity of basestock is from about 5% v/v to about 25% v/v of the high power diesel fuel composition.

17. The high power diesel fuel composition of claim 15 wherein the quantity of basestock is from about 5% v/v to about 25% v/v of the high power diesel fuel composition.

18. The high power diesel fuel composition of claim 12 further comprising from about 50 ppmw to about 1000 ppmw lubricity enhancer.

19. The high power diesel fuel composition of claim 17 further comprising from about 50 ppmw to about 1000 ppmw lubricity enhancer.

20. The high power diesel fuel composition of claim 12 wherein the one or more metal carboxylates is selected from the group consisting of potassium succinate and potassium oleate.

21. The high power diesel fuel composition of claim 17 wherein the one or more metal carboxylates is selected from the group consisting of potassium succinate and potassium oleate.

22. A high power diesel fuel composition comprising:

about 50% v/v or more ultra low sulfur base diesel fuel (ULSD);

from about 5% v/v to about 25% v/v basestock comprising substantially equal amounts of paraffinic basestock and naphthenic basestock;

a basestock having density of at least 0.856 kg/L comprising a combination of from about 2% v/v to about 13% v/v of paraffinic basestock and from about 2% v/v to about 13% v/v of naphthenic basestock;

from about 40 ppmw to about 60 ppmw of one or more metal carboxylate selected from the group consisting of potassium succinate, potassium oleate, and combinations thereof; and, an amount of nitrogen containing cetane improver effective to produce a cetane number of 48 or more.

23. The high power diesel fuel composition of claim 22 wherein the nitrogen containing cetane improver is a nitrate.

24. The high power diesel fuel composition of claim 22 further comprising from about 50 ppmw to about 1000 ppmw lubricity enhancer.

25. The high power diesel fuel composition of claim 23 further comprising from about 50 ppmw to about 1000 ppmw lubricity enhancer.

26. A method for increasing immediate power output of a diesel engine, the method comprising:

providing the diesel engine with a diesel fuel composition having a cetane number of about 48 or more comprising about 50 vol. % or more base diesel fuel, and a concentration of one or more mono- or multi-carboxylic metal carboxylates comprising one or more metal selected from the group consisting of alkali metals, manganese, iron, and combinations thereof; a quantity of basestock having density of at least 0.856 kg/L comprising a combination of from about 2% v/v to about 13% v/v of paraffinic basestock and from about 2% v/v to about 13% v/v of naphthenic basestock; and, operating the diesel engine burning the diesel fuel composition under low speed and high power conditions, producing 2% or more increased immediate power output compared to the immediate power output produced by the same diesel engine burning the base diesel fuel, alone, under the same conditions.

27. The method of claim 26 wherein the increased immediate power output is 6% or more greater than the immediate power output.

28. The method of claim 26 further comprising providing the diesel fuel composition with a quantity of basestock comprising substantially equal amounts of paraffinic basestock and naphthenic basestock.

29. The method of claim 26 further comprising providing the diesel fuel composition with cetane improver effective to produce the cetane number of 48 or more.

30. The method of claim 28 further comprising providing the diesel fuel composition with nitrogen-containing cetane improver effective to produce the cetane number of 48 or more.

31. The method of claim 26 wherein the metal is selected from the group consisting of alkali metals.

32. The method of claim 29 wherein the metal is selected from the group consisting of alkali metals.

33. The method of claim 30 wherein the metal is selected from the group consisting of alkali metals.

34. The method of claim 26 wherein the metal is potassium.

35. The method of claim 29 wherein the metal is potassium.

36. The method of claim 30 wherein the metal is potassium.

37. The method of claim 34 wherein the metal carboxylates are selected from the group consisting of potassium succinate and potassium oleate.

38. The method of claim 35 wherein the one or more metal carboxylates are selected from the group consisting of potassium succinate and potassium oleate.

39. The method of claim 36 wherein the one or more metal carboxylates are selected from the group consisting of potassium succinate and potassium oleate.

* * * * *